US007553196B2

(12) United States Patent
Clark et al.

(10) Patent No.: US 7,553,196 B2
(45) **Date of Patent: *Jun. 30, 2009**

(54) TELECOMMUNICATIONS JACK ASSEMBLY

(75) Inventors: Gordon P. Clark, Eden Prairie, MN (US); Loren J. Mattson, Richfield, MN (US)

(73) Assignee: ADC Telecommunications, Inc., Eden Prairie, MN (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/981,603

(22) Filed: Oct. 31, 2007

(65) Prior Publication Data

US 2008/0299836 A1 Dec. 4, 2008

Related U.S. Application Data

(63) Continuation of application No. 11/245,986, filed on Oct. 7, 2005, now Pat. No. 7,306,492, which is a continuation of application No. 10/938,457, filed on Sep. 9, 2004, now Pat. No. 6,974,352, which is a continuation of application No. 10/302,354, filed on Nov. 22, 2002, now Pat. No. 6,814,624.

(51) Int. Cl.
*H01R 24/00* (2006.01)

(52) U.S. Cl. ..... 439/676; 439/941

(58) Field of Classification Search ..... 439/941, 439/676, 76.1

See application file for complete search history.

(56) References Cited

U.S. PATENT DOCUMENTS

| | | | |
|---|---|---|---|
| 4,274,691 | A | 6/1981 | Abernethy et al. |
| 4,406,509 | A | 9/1983 | Jagen |
| 4,556,264 | A | 12/1985 | Tanaka |
| 4,698,025 | A | 10/1987 | Silbernagel et al. |
| 4,971,571 | A | 11/1990 | Puerner |
| 5,030,123 | A | 7/1991 | Silver |
| 5,041,018 | A | 8/1991 | Arnett |
| 5,044,981 | A | 9/1991 | Suffi et al. |
| 5,071,371 | A | 12/1991 | Harwath et al. |
| 5,156,554 | A | 10/1992 | Rudoy et al. |
| 5,186,647 | A | 2/1993 | Denkmann et al. |
| 5,238,426 | A | 8/1993 | Arnett |
| 5,299,956 | A | 4/1994 | Brownell et al. |
| 5,302,140 | A | 4/1994 | Arnett |

(Continued)

FOREIGN PATENT DOCUMENTS

| | | |
|---|---|---|
| EP | 0 777 304 A2 | 6/1997 |

(Continued)

OTHER PUBLICATIONS

The Siemon Company Catalog pages—front cover page through p. 1.39, and back cover page, dated 1999.

(Continued)

*Primary Examiner*—Briggitte R Hammond
(74) *Attorney, Agent, or Firm*—Merchant & Gould P.C.

(57) ABSTRACT

An electrical connector including a circuit board, a contact spring insert, and an insulation displacement terminal insert wherein the contact spring insert is positioned between the insulation displacement terminal insert and the circuit board. The insert assembly can be mounted to a jack housing to form a telecommunications jack for receiving telecommunications plugs.

9 Claims, 19 Drawing Sheets

U.S. PATENT DOCUMENTS

| | | | |
|---|---|---|---|
| 5,310,363 | A | 5/1994 | Brownell et al. |
| 5,362,257 | A | 11/1994 | Neal et al. |
| 5,399,107 | A | 3/1995 | Gentry et al. |
| 5,403,200 | A | 4/1995 | Chen |
| 5,474,474 | A | 12/1995 | Siemon et al. |
| 5,478,261 | A | 12/1995 | Bogese, II |
| 5,503,572 | A | 4/1996 | White et al. |
| 5,580,257 | A | 12/1996 | Harwath |
| 5,624,274 | A | 4/1997 | Lin |
| 5,639,261 | A | 6/1997 | Rutkowski et al. |
| 5,639,266 | A | 6/1997 | Patel |
| 5,647,043 | A | 7/1997 | Anderson et al. |
| 5,659,650 | A | 8/1997 | Arnett |
| 5,674,093 | A | 10/1997 | Vaden |
| 5,700,167 | A | 12/1997 | Pharney et al. |
| 5,713,764 | A | 2/1998 | Brunker et al. |
| 5,716,237 | A | 2/1998 | Conorich et al. |
| 5,735,714 | A | 4/1998 | Orlando et al. |
| 5,759,070 | A | 6/1998 | Belopolsky |
| 5,779,503 | A | 7/1998 | Tremblay et al. |
| 5,785,546 | A | 7/1998 | Hamai et al. |
| 5,791,935 | A | 8/1998 | Yamanashi |
| 5,791,943 | A | 8/1998 | Lo et al. |
| 5,795,186 | A | 8/1998 | Tulley et al. |
| 5,885,111 | A | 3/1999 | Yu |
| 5,911,602 | A | 6/1999 | Vaden |
| 5,924,896 | A | 7/1999 | Arnett et al. |
| 5,938,479 | A | 8/1999 | Paulson et al. |
| 5,941,734 | A | 8/1999 | Ikeda et al. |
| 5,947,761 | A | 9/1999 | Pepe |
| 5,947,772 | A | 9/1999 | Arnett et al. |
| 6,066,005 | A | 5/2000 | Belopolsky |
| 6,083,052 | A | 7/2000 | Adams et al. |
| 6,086,428 | A | 7/2000 | Pharney et al. |
| 6,089,909 | A | 7/2000 | Tokuwa |
| 6,089,923 | A | 7/2000 | Phommachanh |
| 6,102,722 | A | 8/2000 | Arnett |
| 6,116,964 | A | 9/2000 | Goodrich et al. |
| 6,165,023 | A | 12/2000 | Troutman et al. |
| 6,186,834 | B1 | 2/2001 | Arnett et al. |
| 6,196,880 | B1 | 3/2001 | Goodrich et al. |
| 6,234,836 | B1 | 5/2001 | Schmidt et al. |
| 6,270,358 | B1 | 8/2001 | Nozick |
| 6,305,950 | B1 | 10/2001 | Doorhy |
| 6,334,792 | B1 | 1/2002 | Schmidt et al. |
| 6,350,158 | B1 | 2/2002 | Arnett et al. |
| 6,371,793 | B1 | 4/2002 | Doorhy et al. |
| 6,428,362 | B1 | 8/2002 | Phommachanh |
| 6,554,653 | B2 | 4/2003 | Henneberger |
| 6,814,624 | B2 | 11/2004 | Clark et al. |
| 6,974,352 | B2 | 12/2005 | Clark et al. |

FOREIGN PATENT DOCUMENTS

| | | |
|---|---|---|
| GB | 2314466 A | 12/1997 |
| WO | WO 97/44862 | 11/1997 |
| WO | WO 00/42682 | 7/2000 |

OTHER PUBLICATIONS

Panduit Corp., Tinley Park, Illinois, "Pandiut®Communication Products," cover page pp. 40-49, and back page (1996).

TELECOMMUNICATIONS JACK ASSEMBLY

CROSS REFERENCE TO RELATED APPLICATIONS

This application is a continuation of application Ser. No. 11/245,986, filed Oct. 7, 2005, now U.S. Pat. No. 7,306,492 which is a continuation of application Ser. No. 10/938,457, filed Sep. 9, 2004, now U.S. Pat. No. 6,974,352, which is a continuation of application Ser. No. 10/302,354, filed Nov. 22, 2002, now U.S. Pat. No. 6,814,624, which applications are incorporated herein by reference.

FIELD OF THE INVENTION

The present invention relates generally to telecommunications connectors and to methods for assembling telecommunications connectors.

BACKGROUND OF THE INVENTION

Modular connectors such as modular plugs and modular jacks are commonly used in the telecommunications industry. FIG. 21 illustrates an exemplary modular connector 20 (e.g., an RJ 45 connector). The connector includes eight contacts (e.g., springs) numbered 1 to 8. The eight contacts form four separate circuits or pairs for conveying twisted pair (e.g., tip and ring) signals. FIG. 21 shows a conventional pairing configuration in which springs 4 and 5 form a first circuit, springs 3 and 6 form a second circuit, springs 1 and 2 form a third circuit, and springs 7 and 8 form a fourth circuit.

Crosstalk can be a significant source of interference in telecommunications systems. Crosstalk is typically caused by the unintentional transfer of energy from one signal pair to another. Commonly, the transfer of energy is caused by inductive or capacitive coupling between the conductors of different circuits. Crosstalk is particularly problematic in modular connectors because of the close spacing of the springs.

To reduce crosstalk, a variety of spring configurations have been developed. Often, the spring shapes are quite complicated and the springs can be difficult to assemble and maintain in the desired orientations suitable for reducing crosstalk. Ease of assembly and compactness of design of the modular jacks are desired. What is needed is an improved modular jack and method for assembling contact springs in a telecommunications connector.

SUMMARY OF THE INVENTION

One aspect of the present invention relates to an insert assembly for a jack for use with a plug having plug contacts, the insert assembly including a circuit board, a contact spring insert, and an insulation displacement terminal insert. The contact spring insert includes a plurality of contact springs including tips for electrically connecting to the circuit board. The insulation displacement terminal insert includes a plurality of insulation displacement terminals including tips for electrically connecting to the circuit board. The insulation displacement terminal insert is positioned adjacent to the contact spring insert, and both inserts are positioned adjacent to the circuit board during assembly.

A method for assembling an insert assembly for a jack includes providing a circuit board, a contact spring insert with spring tips, and an insulation displacement terminal insert with terminal tips. The contact spring insert is positioned between the insulation displacement terminal insert and the circuit board, with the spring tips and the terminal tips positioned adjacent to the circuit board. The method further includes the step of permanently electrically connecting the tips to the circuit board. One preferred method of connecting includes a soldering operation. The method further preferably includes slidably mounting the insert assembly into a jack housing to form a telecommunications jack.

A variety of advantages of the invention will be set forth in part in the description that follows, and in part will be apparent from the description, or may be learned by practicing the invention. It is to be understood that both the foregoing general description and the following detailed description are exemplary and explanatory only and are not restrictive of the invention as claimed.

BRIEF DESCRIPTION OF THE DRAWINGS

The accompanying drawings, which are incorporated in and constitute a part of this specification, illustrate several aspects of the invention and together with the description, serve to explain the principles of the invention. A brief description of the drawings is as follows.

DETAILED DESCRIPTION OF THE PREFERRED EMBODIMENT

Figure 1:
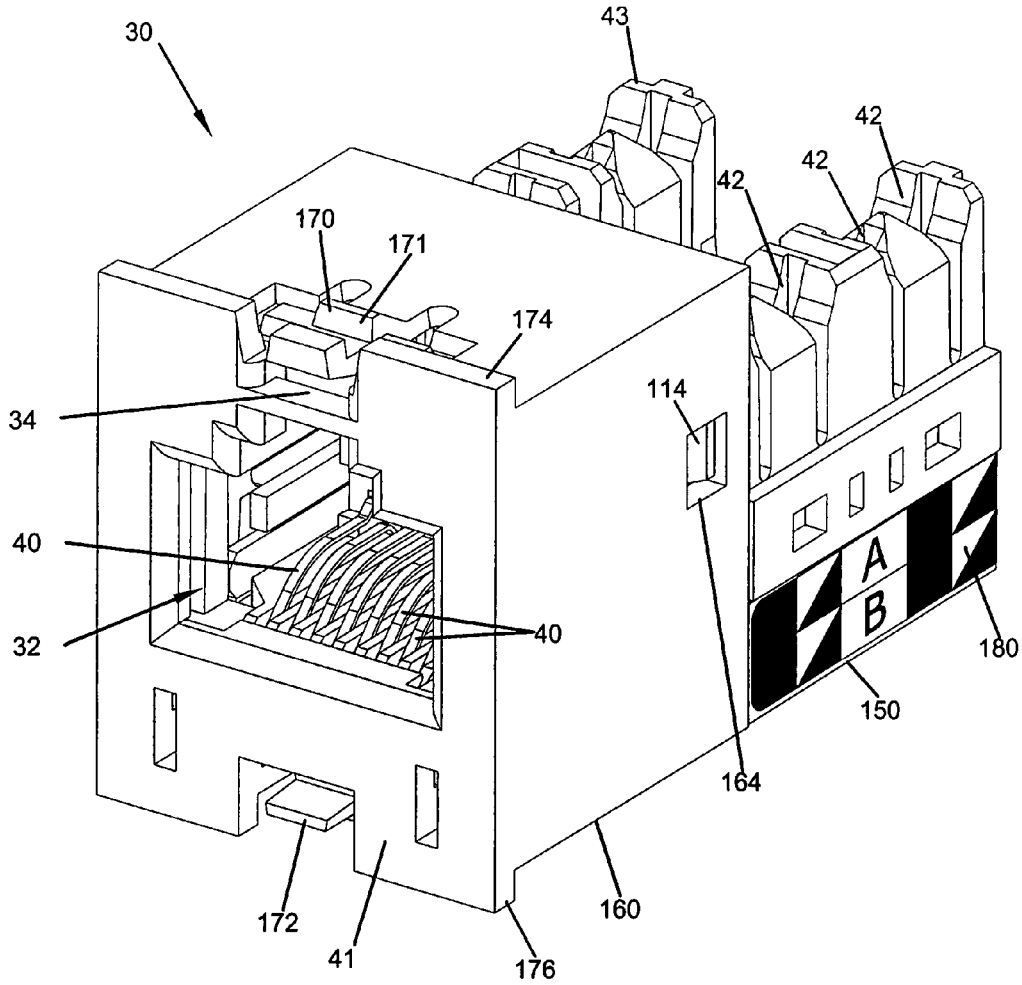
FIG. 1 is a top, front perspective view of a modular jack in accordance with the principles of the present invention.
Figure 2:
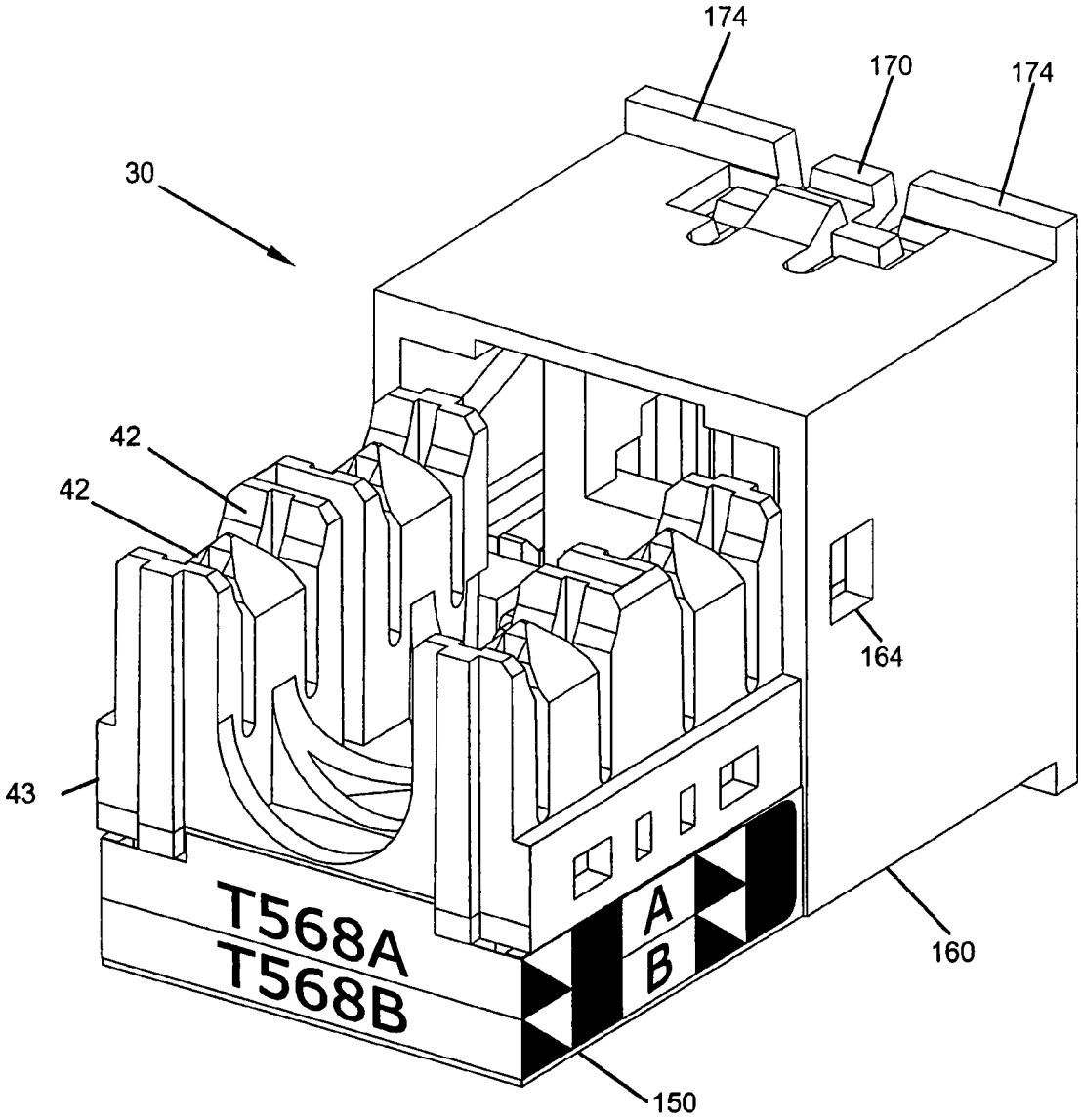
FIG. 2 is a top, rear perspective view of the modular jack of FIG. 1.
Figure 3:
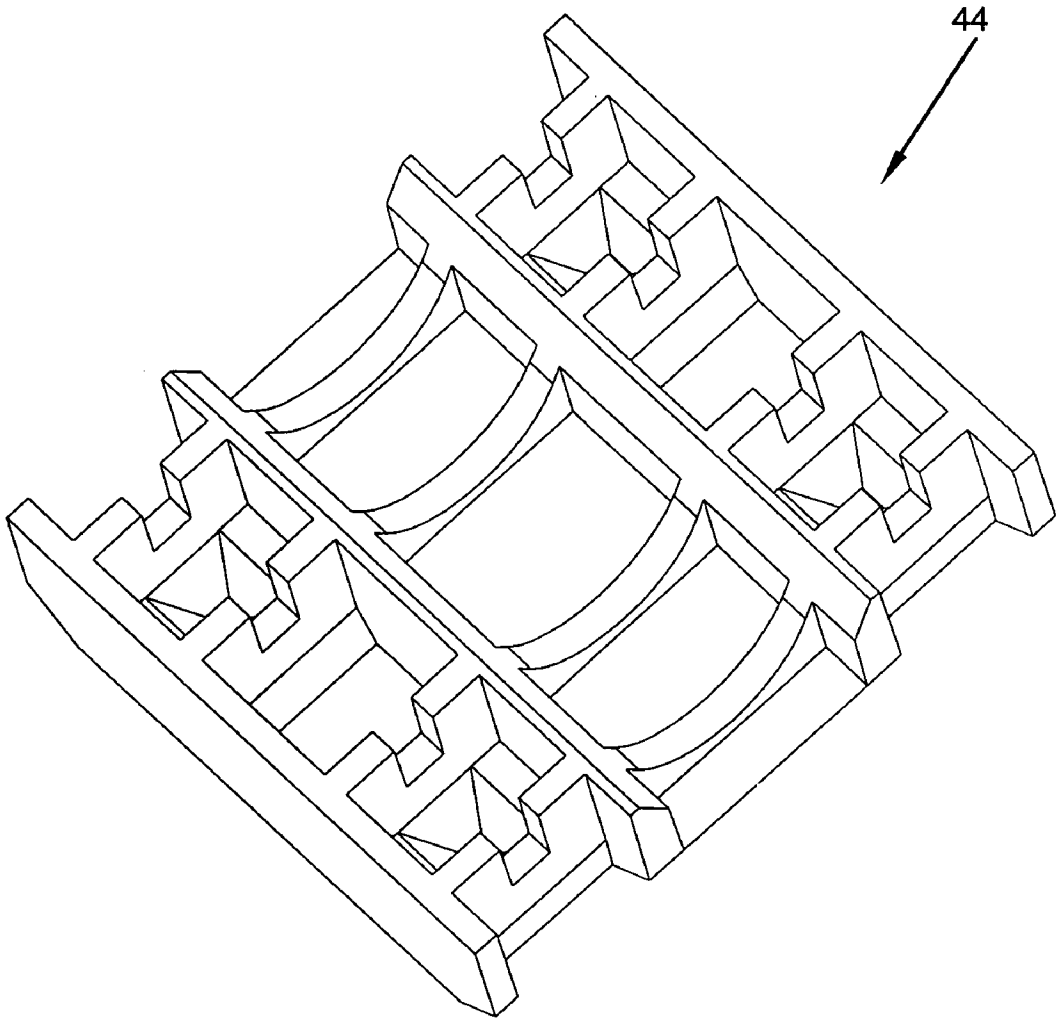
FIG. 3 is a bottom perspective view of an insulation displacement terminal cap used with the jack of FIGS. 1 and 2.
Figure 4:
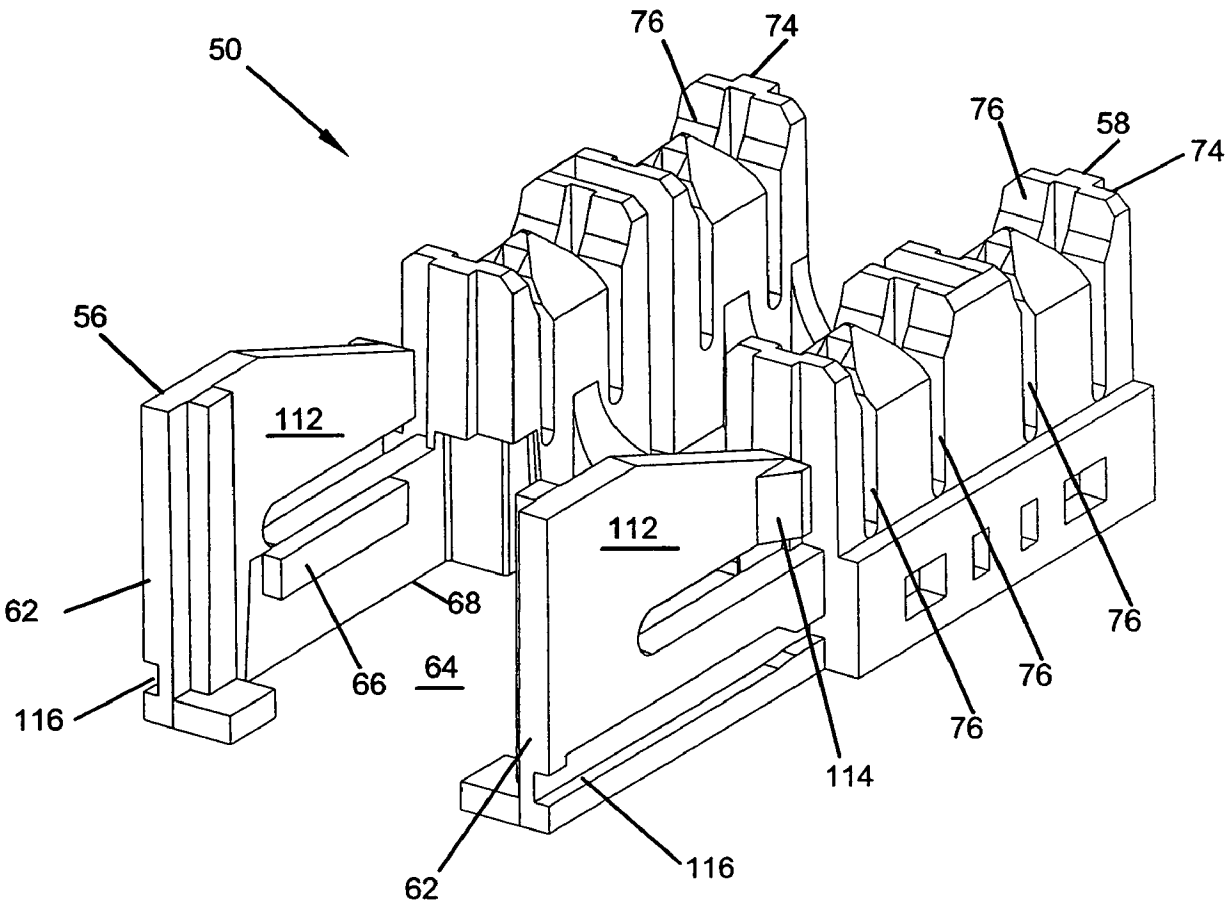
FIG. 4 is a top, front perspective view of the insulation displacement terminal housing used in the jack of FIGS. 1 and 2.
Figure 5:
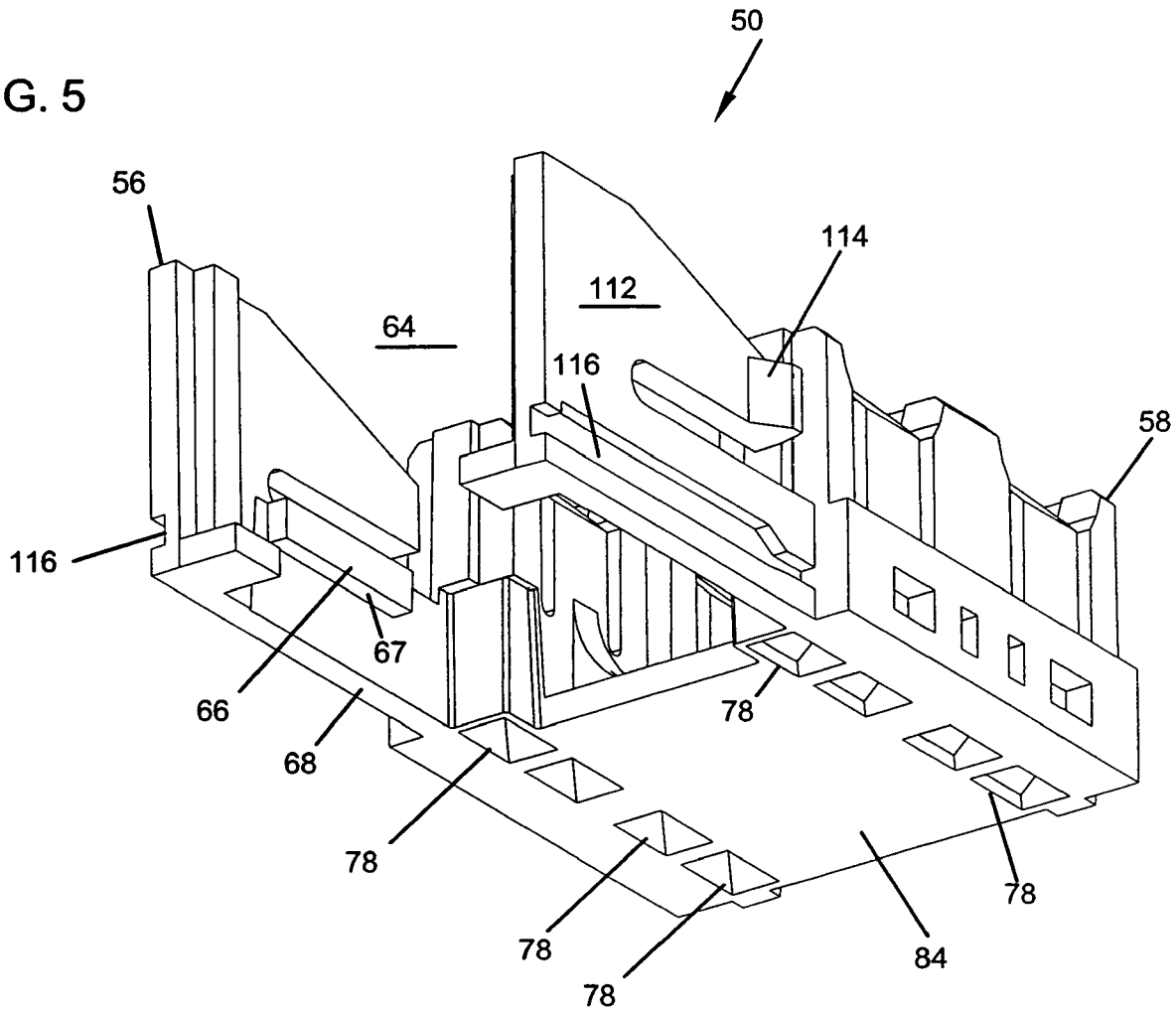
FIG. 5 is a bottom, front perspective view of the housing shown in FIG. 4.
Figure 6:
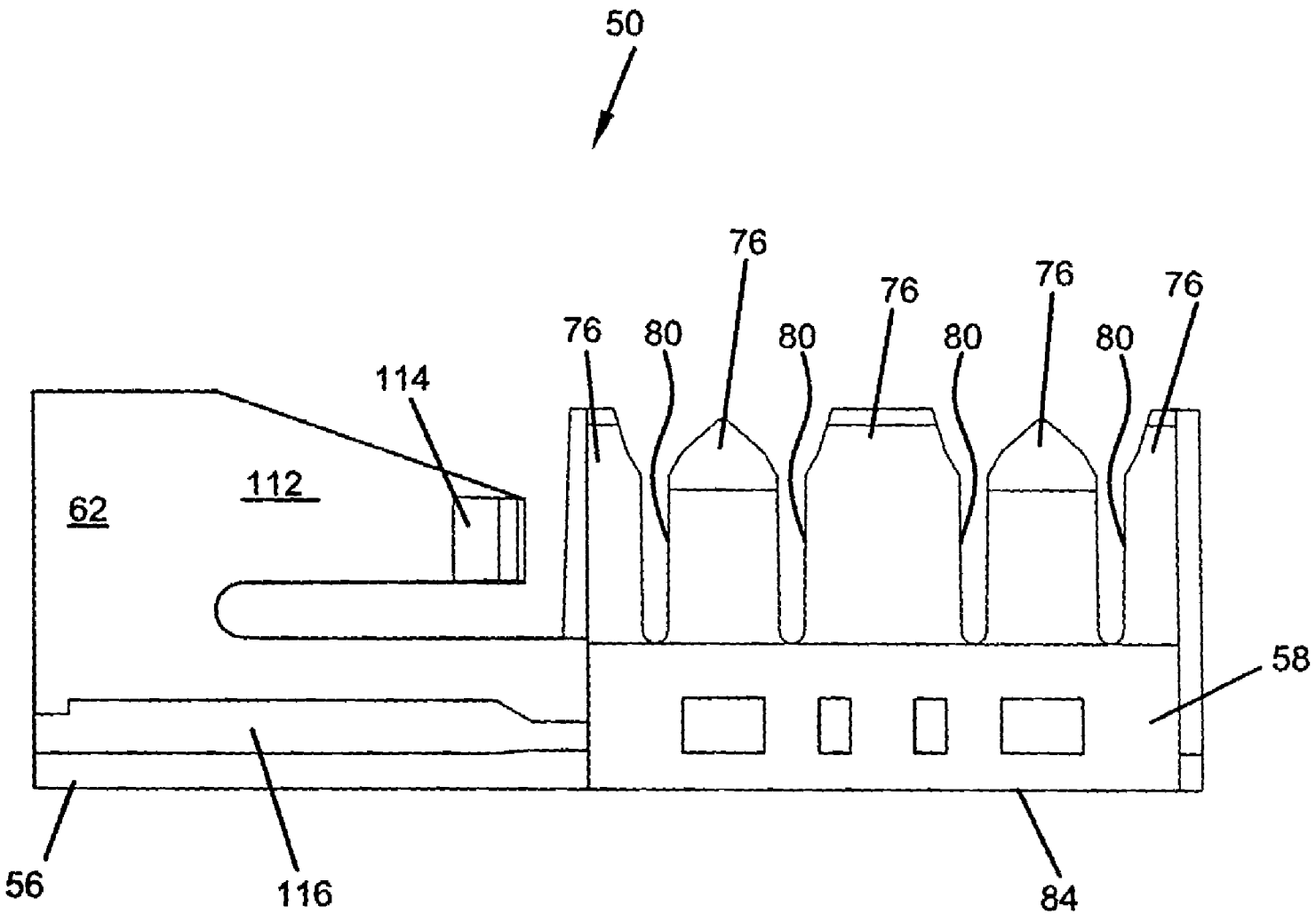
FIG. 6 is a side view of the housing of FIG. 4.
Figure 7:
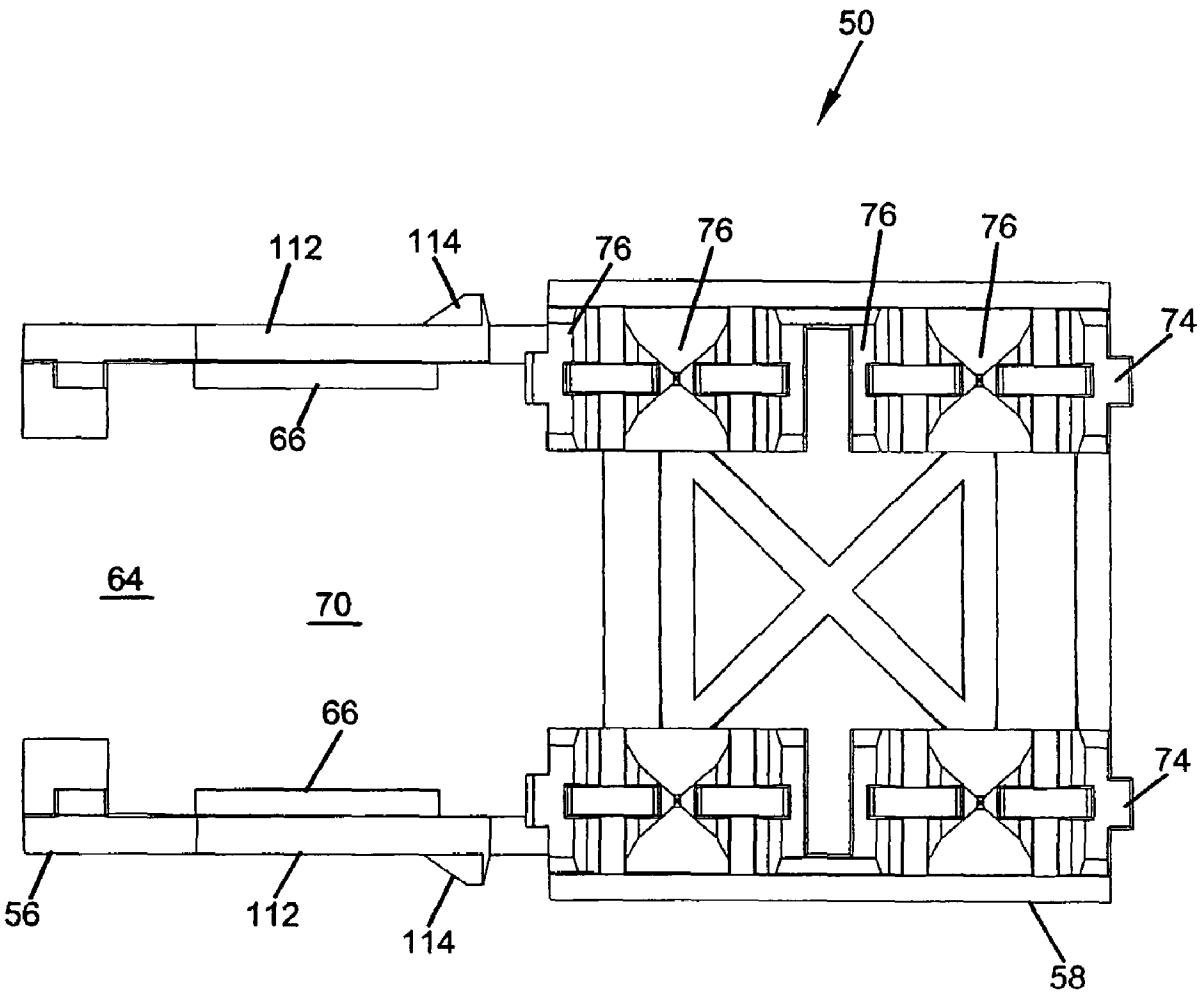
FIG. 7 is a top view of the housing of FIG. 4.
Figure 8:
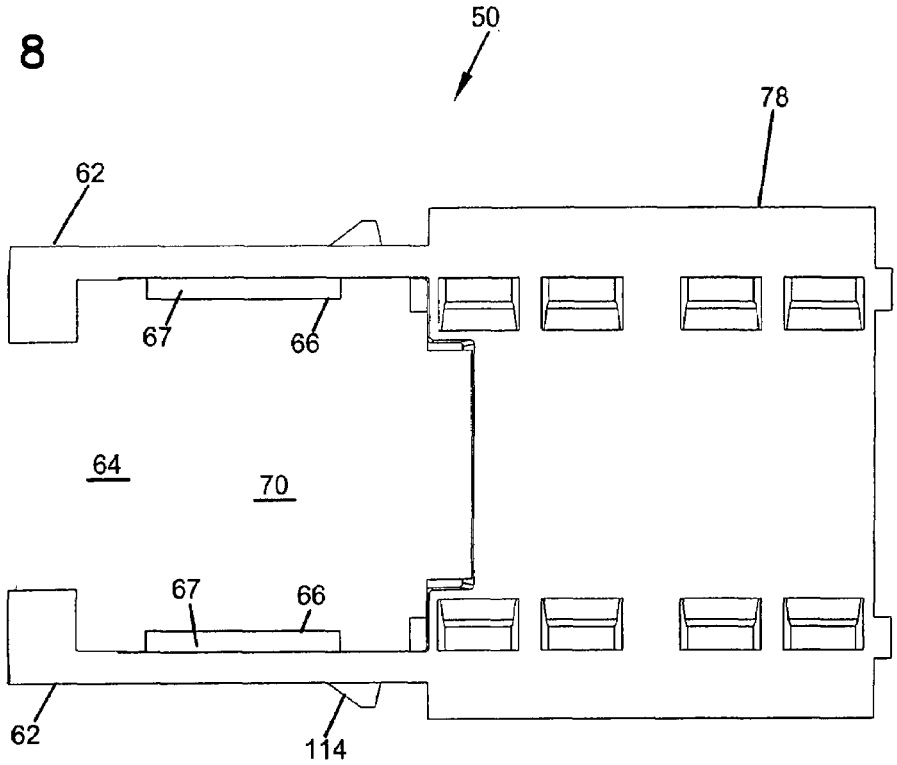
FIG. 8 is a bottom view of the housing of FIG. 4.
Figure 9:
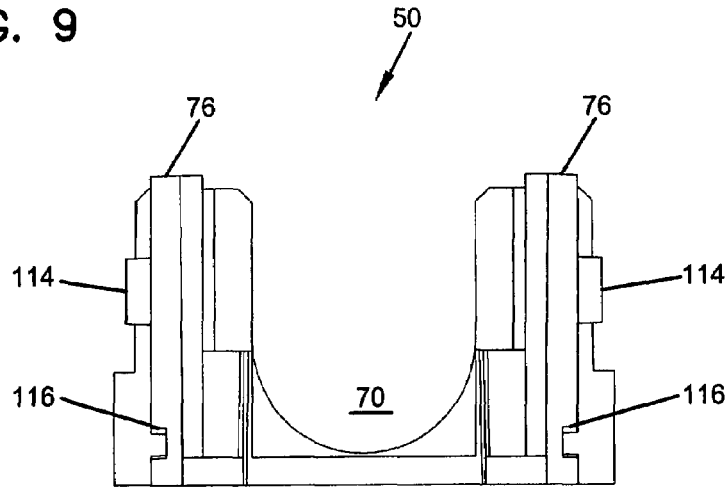
FIG. 9 is a front end view of the housing of FIG. 4.

Referring now to FIGS. 1 and 2, a jack 30 is shown for receiving a telecommunications plug in a front port 32. Jack 30 includes conductive contact springs 40 at a front 41 of jack 30 which are electrically linked to contacts 42 at a rear 43 of jack 30, such as insulation displacement terminals for connecting to twisted pair conductive wires. Front contact springs 40 are provided to electrically connect to the electrical terminations in the telecommunications plug. Typically the jack 30 will include eight circuit paths through the jack, for connecting to the twisted wire pairs of two telecommunications cables, one connected at port 30, and one cable connected at terminals 42. FIG. 3 shows an insulation displacement terminal cap 44 for mounting over rear contacts 42 during use, such as through a snap fit. A front tab 34 of jack 30 engages a locking tab of the plug to hold the plug in electrical connection with jack 30.

U.S. Pat. Nos. 6,234,836 and 6,334,792 disclose various telecommunications jacks including contact springs mounted to an insert assembly, for use with a jack housing for twisted wire pair cables. A further telecommunications jack is shown in U.S. patent application Ser. No. 09/811,148. An example telecommunications plug with plug contacts is shown in U.S. Pat. No. 6,334,792. All of the disclosures of the above-noted documents are hereby incorporated by reference. Individual contact springs are shown in the noted documents as being mounted to an insert assembly which functions as a contact spring holder. The present invention relates to an improved method of assembly, and a jack and insert assembly for a jack wherein the contact springs are mounted together and then mated with an insert housing containing cable connections to form an insert assembly useful in telecommunications jacks. FIGS. 4-20 show and describe various components, assemblies, and method steps useable in assembling improved jack 30.

Turning now to FIGS. 4-12, an insulation displacement terminal housing or main body 50, and an insulation displacement terminal insert 52 including housing 50 and a plurality of insulation displacement terminals 54 are shown. Housing 50 includes a front 56 and a rear 58 and is made from non-conductive material, such as molded plastic. Front 56 includes opposed sides 62 defining a front opening 64. Inner rails 66 project inwardly toward one another above a lower surface 68 of opposed sides 62. A chamber 70 is defined for receipt of a contact spring insert 90, as will be described below.

Figure 10:
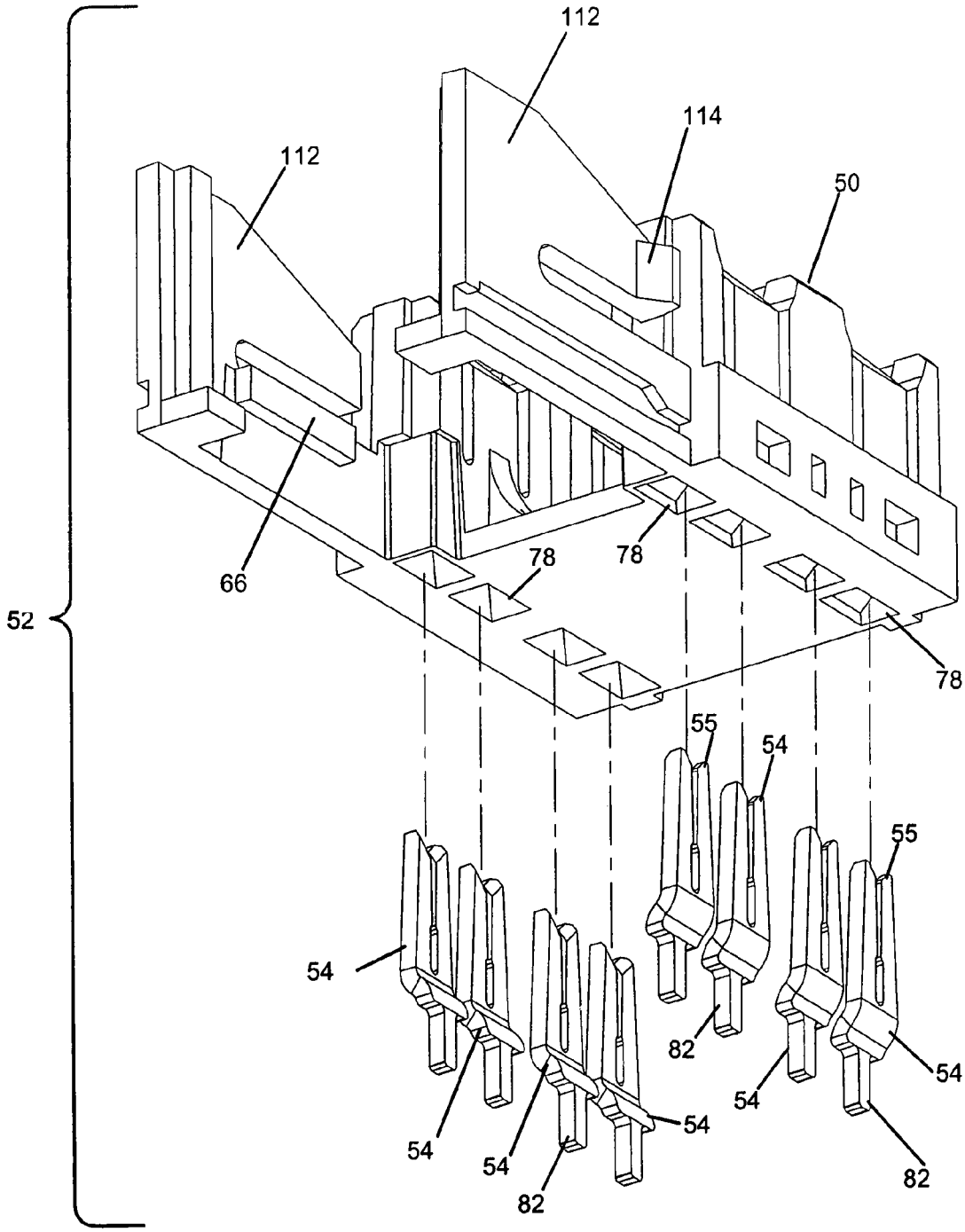
FIG. 10 shows the housing of FIG. 4 with insulation displacement terminals prior to insertion of the terminals into the housing during assembly.
Figure 11:
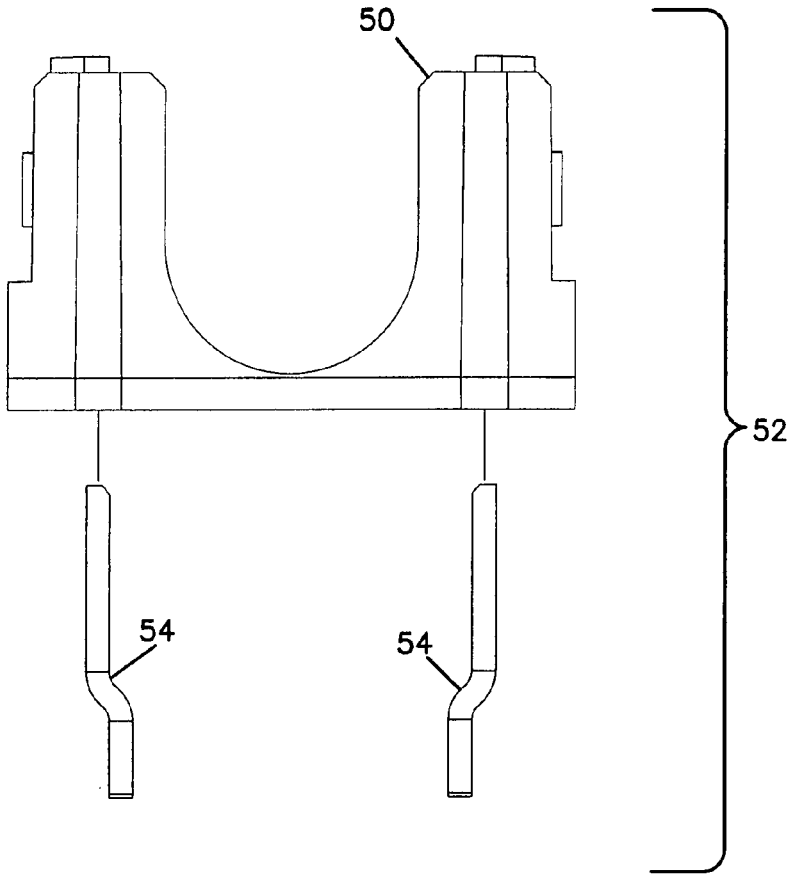
FIG. 11 is a front end view of the housing and terminals shown in FIG. 10.
Figure 12:
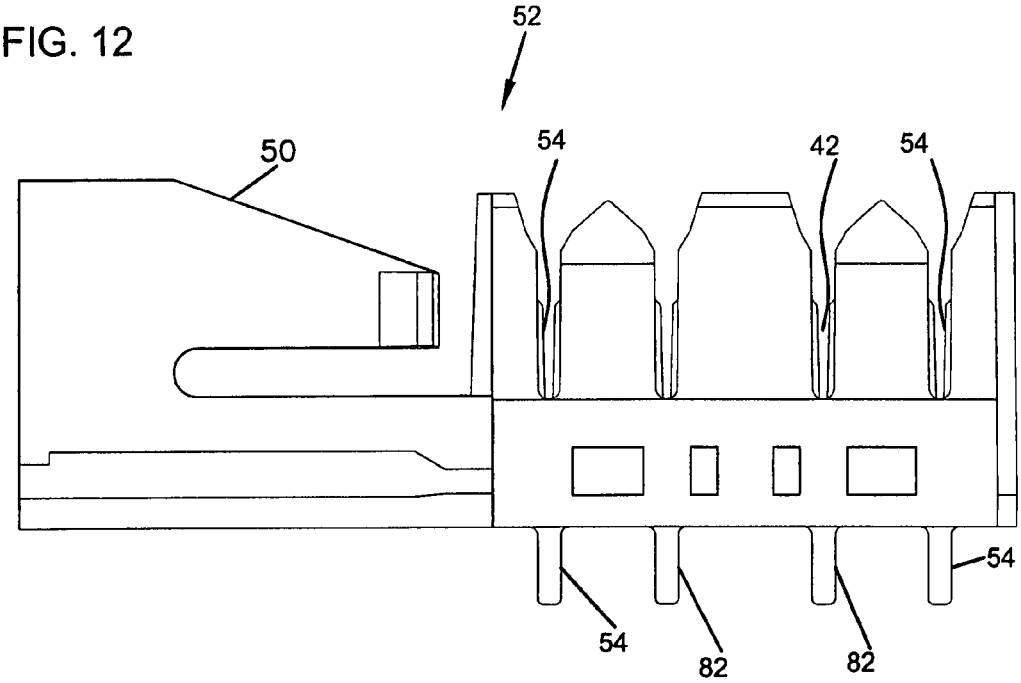
FIG. 12 is a side view of the assembled housing and terminals forming an insulation displacement terminal insert.

Rear 58 of housing 50 includes two rows 74 of terminal housings 76. As shown in FIGS. 10-12, bottom openings 78 receive conductive insulation displacement terminals 54. Each terminal 54 is inserted upwardly into a bottom opening 78. Each terminal 54 has a split end 55 which allows for receipt of a conductive wire at a top 80 of each of the terminal housings 76. Tips 82 of insulation displacement terminals 54 project below a bottom surface 84 of housing 50. Insulation displacement terminals 54 are press fit into housing 50 in the illustrated embodiment. Together, housing 50 and terminals 54 form insulation displacement terminal insert 52 useful in jack 30.

Figure 13:
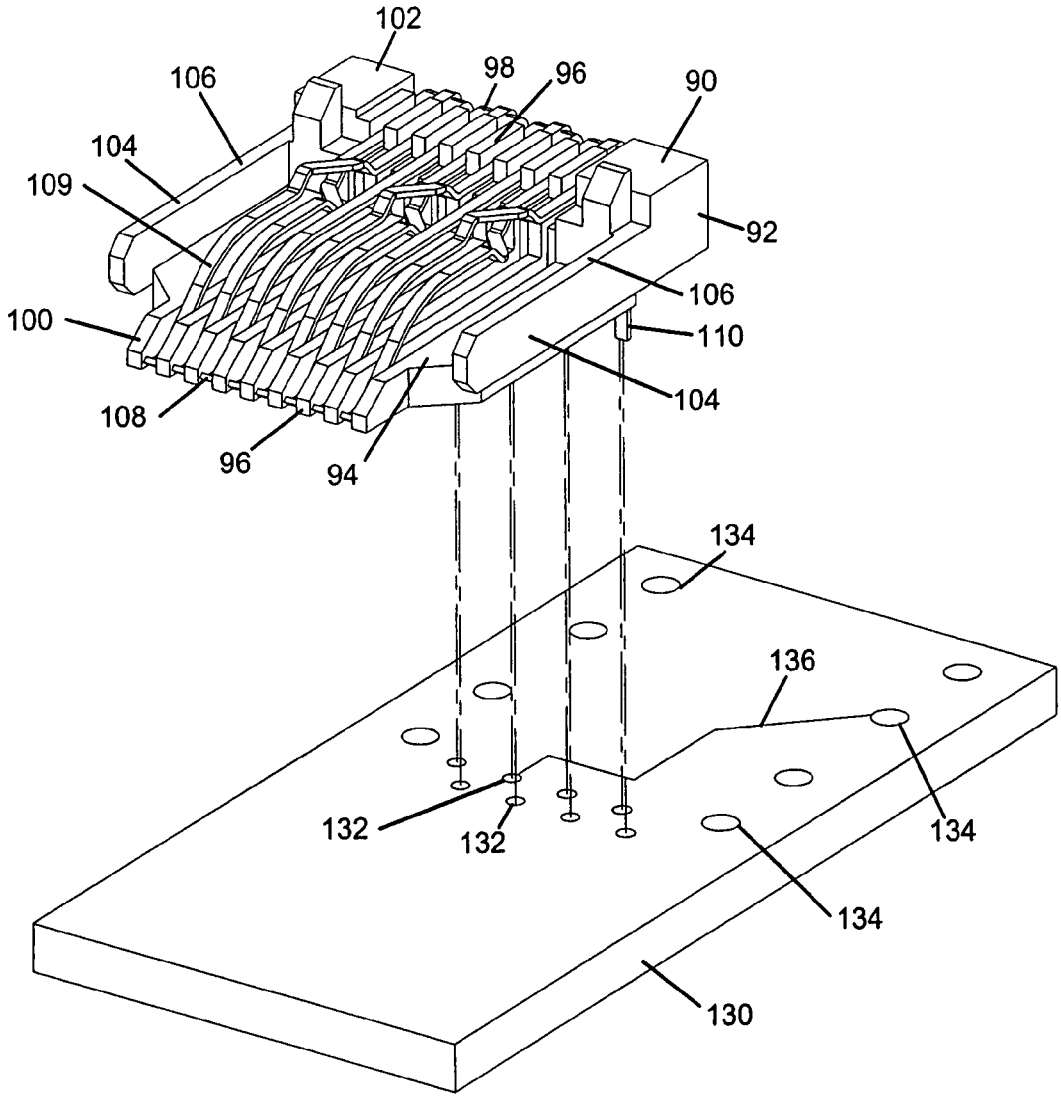
FIG. 13 is a top, front perspective view of a circuit board and a contact spring insert prior to being positioned adjacent to one another during assembly.
Figure 14:
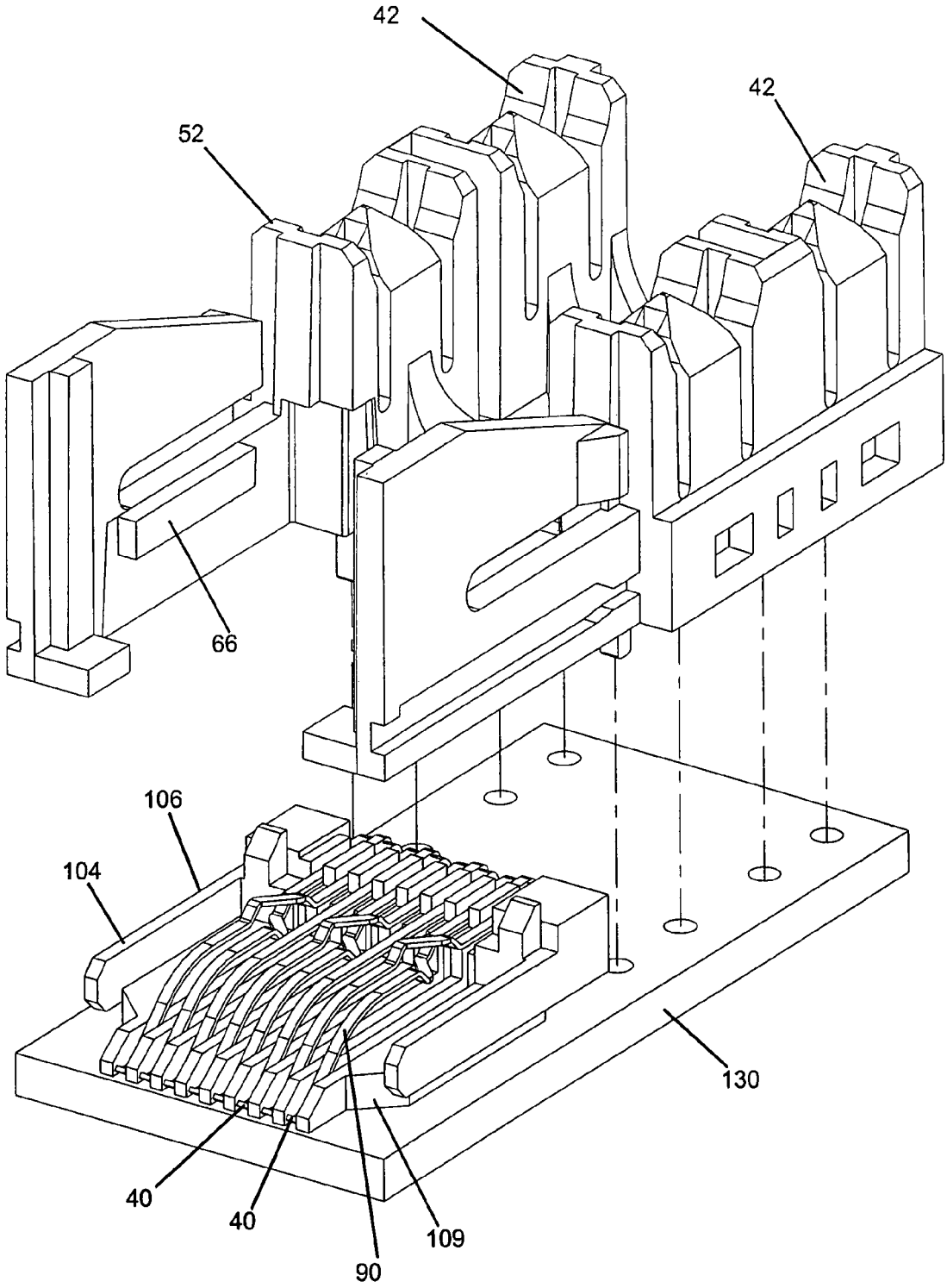
FIG. 14 shows the circuit board and the contact spring insert positioned adjacent to one another, and the insulation displacement terminal insert of FIG. 12 prior to being positioned adjacent to the circuit board and contact spring insert during assembly to form an insert assembly.

Turning now to FIGS. 13 and 14, further steps in the assembly process of jack 30 are shown. Contact spring insert 90 holds an array of contact springs 40 in desired positions for use in jack 30. Contact spring insert 90 can be handled as a unit without disruption of the contact spring spacings. Springs 40 and insert 90 can have a variety of shapes, as desired for the electrical performance of jack 30. For example, some of the springs 40 cross-over one another to address crosstalk issues through the jack 30. Other spring shapes can be used. Insert 90 holds the individual springs 40 in the desired positions.

Contact spring insert 90 includes a non-conductive main body 92 having a base 94 defining a divider 96 for separating the contact springs 40. Body 92 can be made from molded plastic. A holder region 98 on base 94 retains each of the contact springs 40 to body 92, such as through a press-fit connection. Each of contact springs 40 includes a distal tip 108, and an opposite proximal tip 110. Distal tips 108 are located adjacent to a front 100 of body 92. Proximal tips 110 of contact springs 40 are located adjacent to a rear 102 of body 92. Contact portions 109 are positioned to engage the plug contacts of the plug inserted into jack 30. Sides 104 of body 92 project upwardly and define upper surfaces 106.

During assembly, contact spring insert 90 is positioned adjacent to circuit board 130 wherein the proximal tips 110 of spring contacts 40 project into circuit board 130 at first contact locations 132. Insulation displacement terminal insert 52 is then positioned adjacent to circuit board 130 with opening 64 receiving contact spring insert 90 in chamber 70. Tips 82 of insulation displacement terminals 54 also project into circuit board 130 at second contact locations 134. The three components (insert 52, insert 90, and board 130) are secured together to form a unit or assembly 150 for use in jack 30. One preferred method is illustrated where insert 90 is trapped between insert 52 and board 130, and then tips 82, 110 are soldered to board 130. Snaps or other retention structures can be used to hold inserts 52, 90 and board 130 together. Also, solderless connections between tips 82, 110 can be used, if desired.

Figure 15:
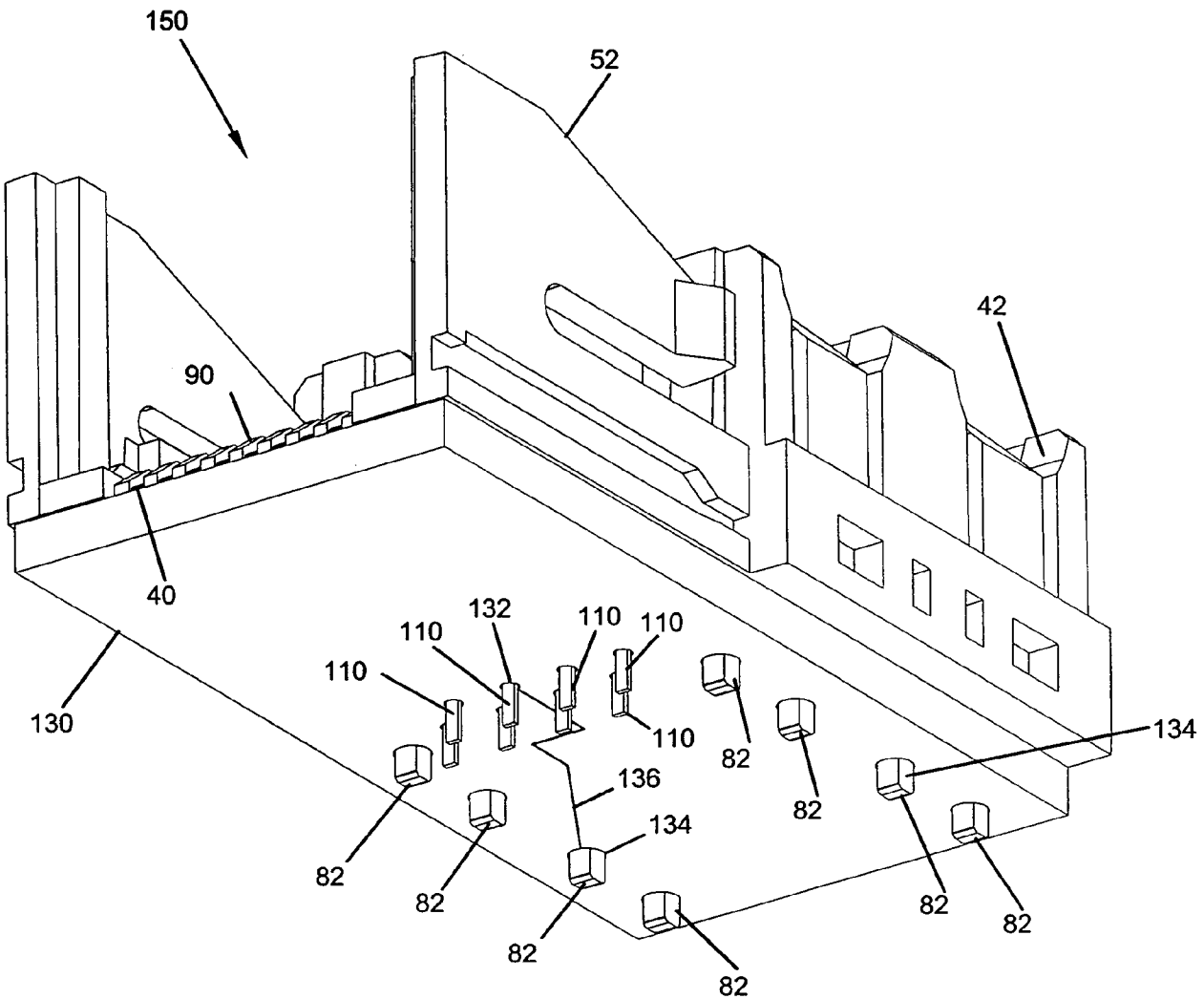
FIG. 15 shows a front, bottom perspective view of the insert assembly.
Figure 16:
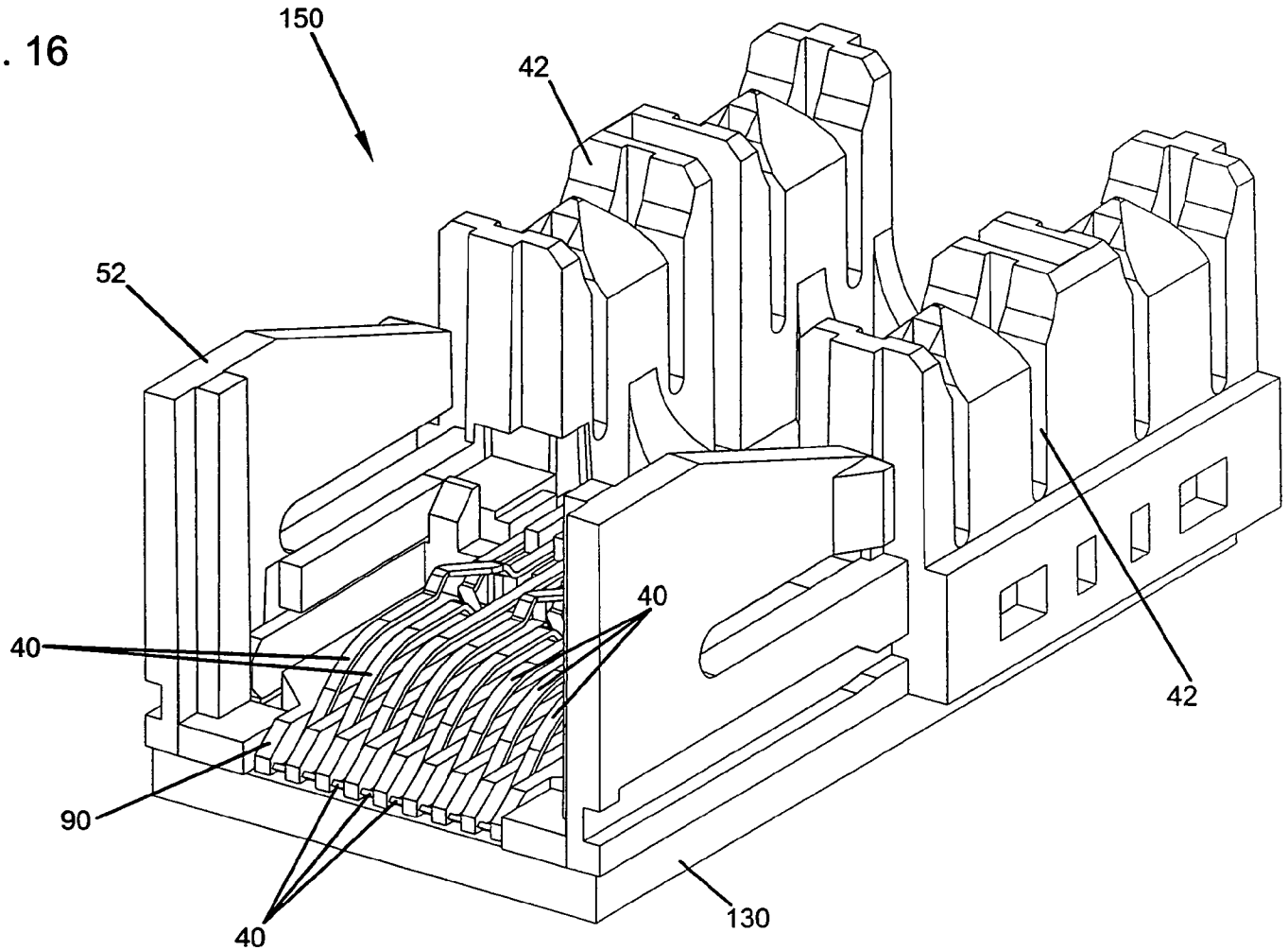
FIG. 16 is a front, top perspective view of the insert assembly of FIG. 15.
Figure 17:
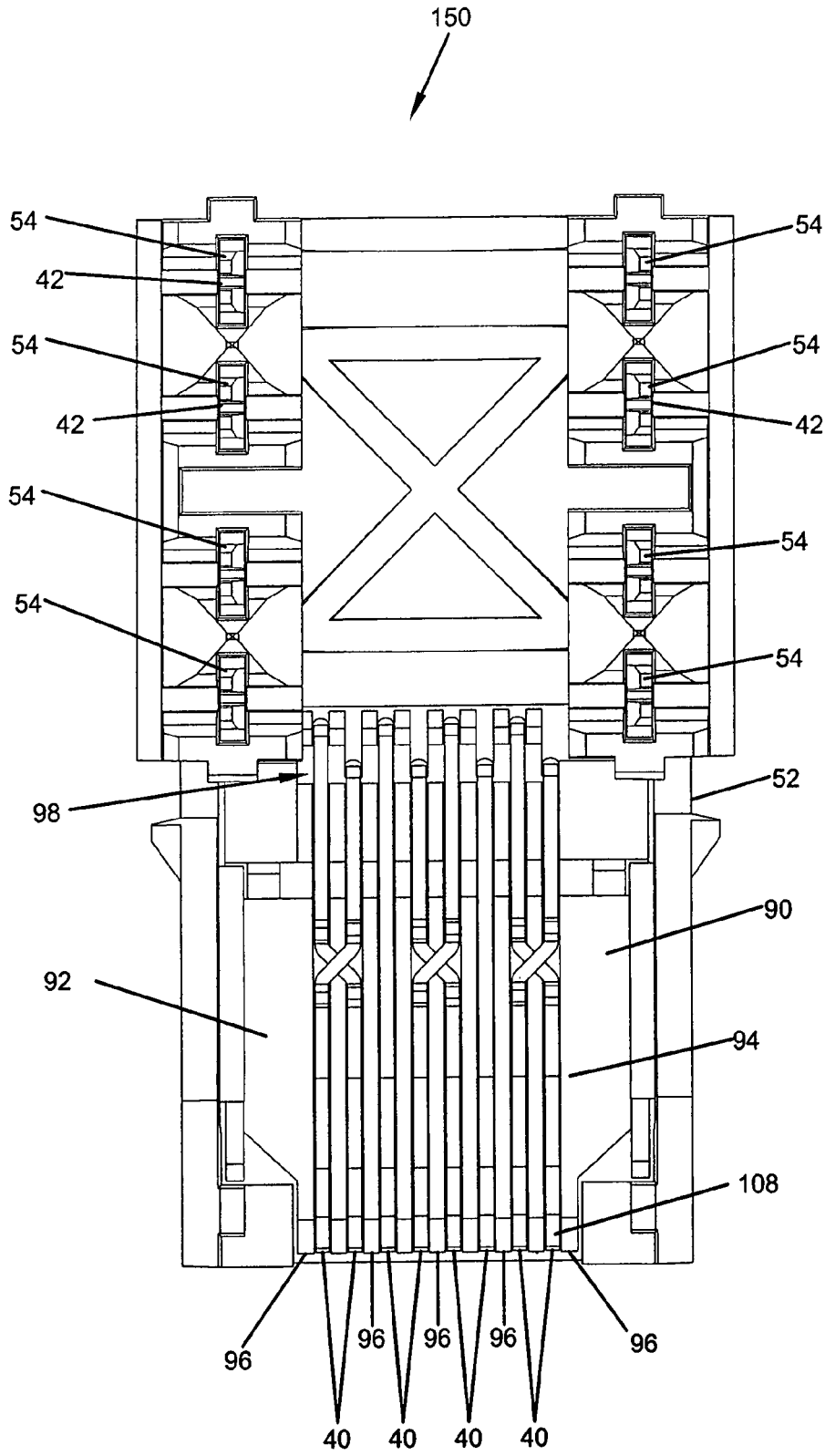
FIG. 17 is a top plan view of the insert assembly of FIG. 15.

Referring now to FIGS. 13-17, tips 82 of insulation displacement terminals 54 and proximal tips 110 of contact springs 40 project into circuit board 130. As shown in FIG. 15, tips 82, 110 project completely through-board 130. Once the elements are positioned adjacent to one another as shown in FIGS. 15-17, the various tips 82, 110 are soldered to board 130. Board 130 includes contact eight locations 132 for receipt of proximal tips 110 of contact springs 40. Eight contact locations 134 receive tips 82 of insulation displacement terminals 54. The circuit tracings 136 (only two are shown) electrically link the first and second contact locations 132, 134. In this manner, signals can be transmitted from contact springs 40 engaged with a telecommunications plug to a telecommunications cable connected to rear contacts 42 defined by the insulation displacement terminals 54.

Circuit board 130 can include other features as desired to enhance electrical performance. The circuit board 130 can include additional conductive pathways that help reduce crosstalk. For example, the crosstalk reducing techniques shown and described in U.S. Pat. Nos. 6,089,923 and 6,428,362, can be used. The disclosures of U.S. Pat. Nos. 6,089,923 and 6,428,362 are hereby incorporated by reference.

In this manner, an insert assembly 150 can be formed wherein contact springs 40 are not separately handled with respect to the insulation displacement terminals 54 and housing 50. Instead, contact springs 40 are separately mounted to insert 90, then insert 90 is mated with the other components to form jack 30. Contact spring insert 90 is retained between circuit board 130 and insulation displacement terminal insert 52 through a lower surface 67 of inner rails 66 engaging sides 104 along top surfaces 106. Once all of the springs and terminals are soldered to board 130, insert assembly 150 can be assembled with other jack housing components.

Figure 18:
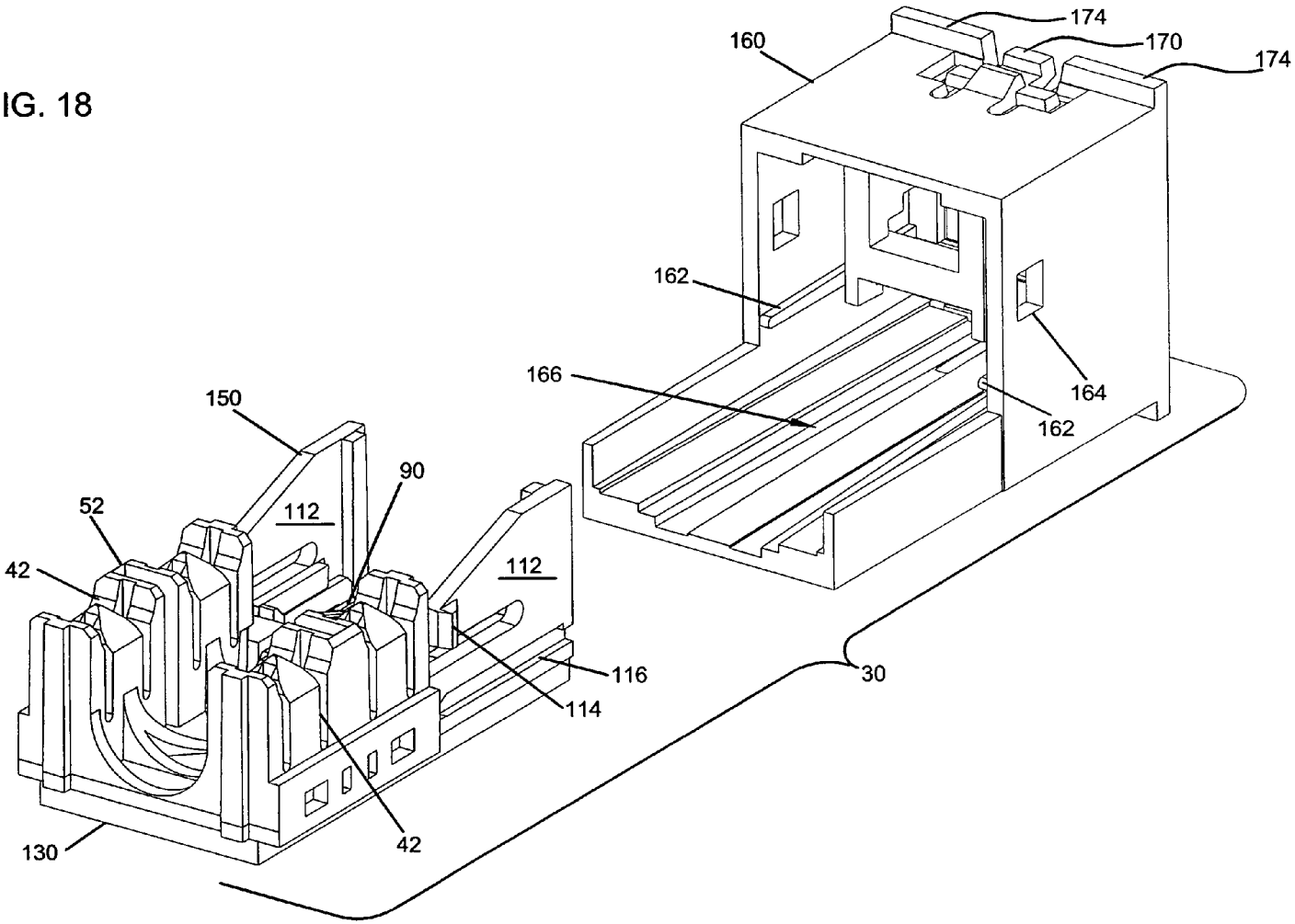
FIG. 18 is a top, rear perspective view of the insert assembly and a jack housing shown prior to insertion of the insert assembly into the jack housing to form the jack.
Figure 19:
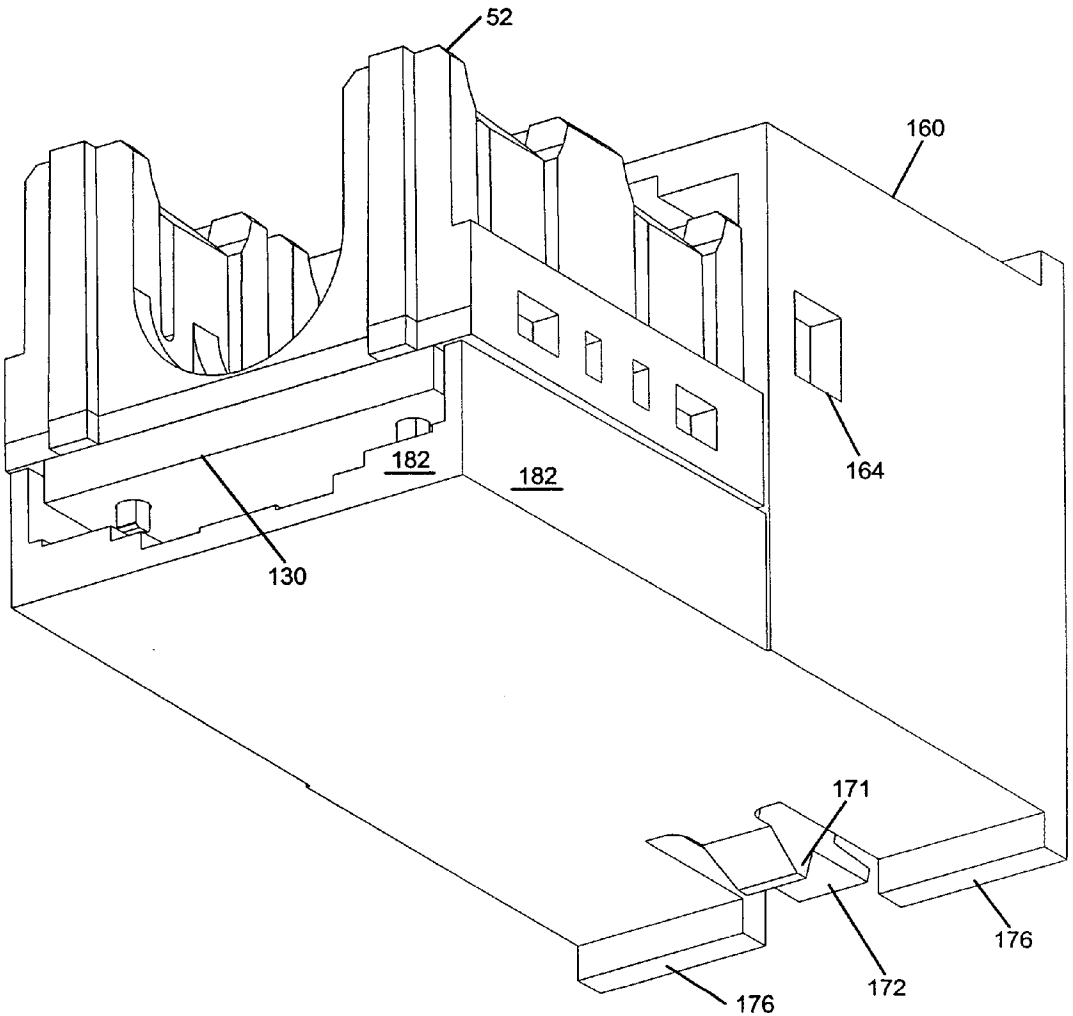
FIG. 19 is a bottom, rear perspective view of the assembled jack.

Turning now to FIGS. 18 and 19, further steps in the assembly process are illustrated. Insulation displacement terminal insert 52 is provided with outwardly facing slots 116 on either side, and a resilient locking tab 112 on either side. Resilient locking tabs 112 include flexible lever members 114 to provide a snap fit engagement with a jack housing 160. Jack housing 160 includes guide rails 162 for receipt of slots 116. Jack housing 160 further includes latch openings 164 for receipt of flexible lever members 114. Rails 162 support insert assembly 150 so that circuit board 130 is spaced from jack housing 160. Jack housing 160 defines an open channel 166 for slidably receiving insert assembly 150. Once slidably received, insert assembly 150 snaps to jack housing 160 to be retained therewith.

Once assembled together, insert assembly 150 and jack housing 160 define jack 30 which can be mounted to a telecommunications panel, faceplate, or other mounting fixture, as desired. Jack 130 includes cantilever members 170, 172, and retaining shoulders 174, 176 for mounting to a faceplate or other panel structure. Each cantilever member 170, 172 includes a retaining tab 171. In the embodiment shown, jack 30 is mounted from the front of the panel. The panel is held between the retaining tabs 171 and the retaining shoulders 174, 176. The earlier mentioned U.S. Pat. No. 6,234,836 shows various jack housings for use with a faceplate. The jack housing 160 can mount perpendicularly to the faceplate or at an angle, as also shown in U.S. Pat. No. 6,234,836 with a differently configured jack housing. Cantilever members 170, 172 and retaining shoulders 174, 176 are shown for example only. Other mounting structures for mounting jack 30 to a panel structure can be used, as desired.

Figure 20:
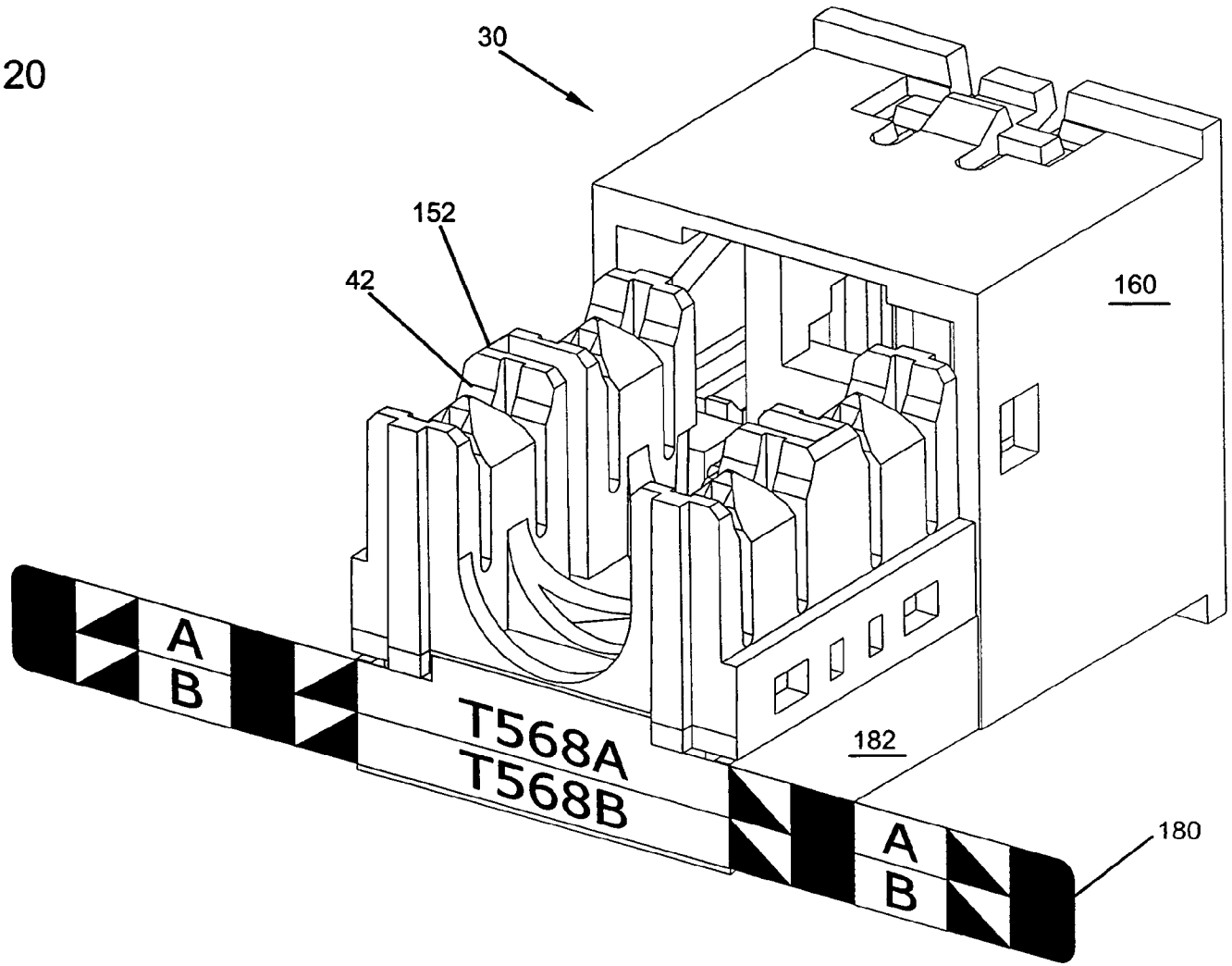
FIG. 20 is a top, rear perspective of the assembled jack, and showing a designation label partially affixed during assembly.
Figure 21:
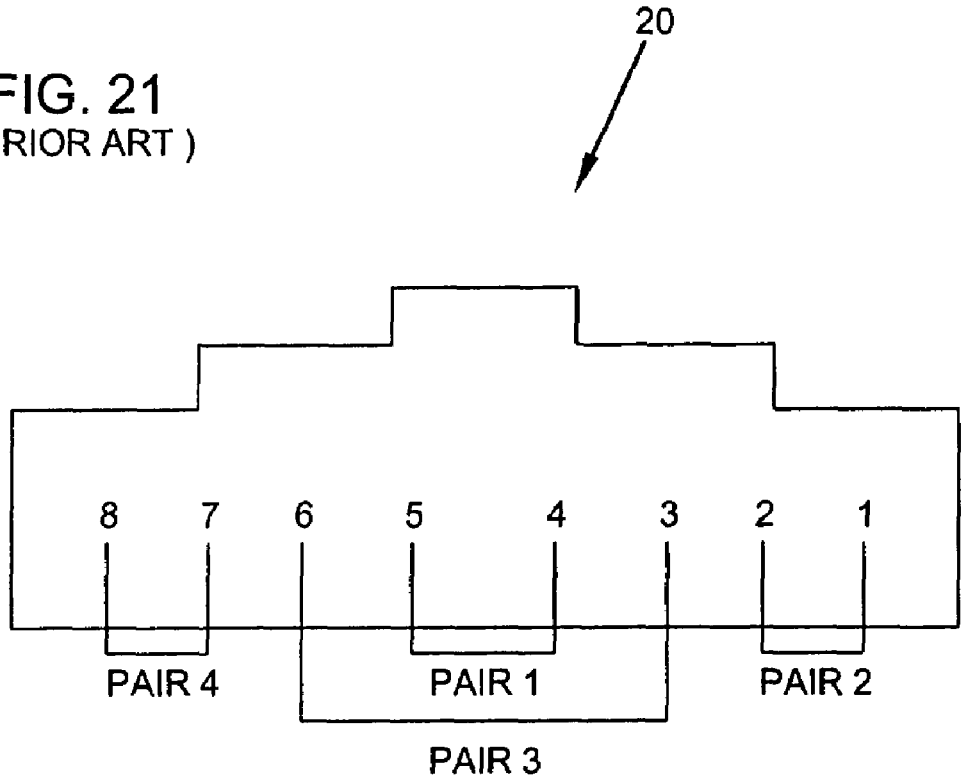
FIG. 21 ( PRIOR ART )
FIG. 21 schematically shows a prior art modular jack.

Referring now to FIG. 20, jack 30 is shown during a further assembly step wherein a designation label 180 is applied. Label 180 is applied to mounting surfaces 182, to provide the user with an identification of the insulation displacement terminals for one or more cabling schemes. For example, the wire pairs for contact springs 40 may vary, so the user would benefit from the indicia on label 180 showing the user the corresponding insulation displacement terminals 54.

With regard to the foregoing description, it is to be understood that changes may be made in detail, especially in matters of the construction materials employed and the shape, size, and arrangement of the parts without departing from the scope of the present invention. It is intended that the specification and depicted aspects of the invention may be considered exemplary, only, with a true scope and spirit of the invention being indicated by the broad meaning of the following claims.

What is claimed is:

1. An insert assembly for a telecommunications jack for use with a plug having plug contacts, the insert comprising:

a) an insulation displacement terminal insert having a main body including a first side positioned opposite from a second side, the insulation displacement terminal insert including:

i) a snap-fit connection structure positioned at the main body for securing the insulation displacement terminal insert to the jack;

ii) an insulation displacement terminal housing positioned at the first side of the main body;

iii) a plurality of insulation displacement terminals housed by the insulation displacement terminal housing, the insulation displacement terminals each including a tip positioned at the second side of the main body;

b) a contact spring insert including a plurality of contact springs held by the contact spring insert, the contact spring insert including a first side positioned opposite from a second side, the contact springs including contact portions positioned at the first side of the contact spring insert for engaging the plug contacts of the plug, the contact springs each including a tip positioned at the second side of the contact spring insert;

c) a circuit board providing electrical connections between the tips of the insulation displacement terminals and the tips of the contact springs, the circuit board being mounted adjacent to the second side of the main body and the second side of the contact spring insert.

2. A method of assembling a telecommunications jack, the method comprising:

providing a jack housing including a front portion positioned opposite from a back portion, the front portion defining a front opening sized for receiving a plug, the back portion defining an open channel, the jack housing further including a base and two opposite facing side walls, the base and the side walls defining at least a portion of the open channel, the jack housing including longitudinal guides extending in a direction from the front portion toward the back portion;

providing a circuit board including electrical tracings thereon;

providing a contact spring insert including contact springs with spring tips, providing an insulation displacement terminal insert including a main housing with a top side positioned opposite a bottom side, the insulation displacement terminal insert including mating longitudinal guides for slidably mating with the longitudinal guides of the jack housing;

inserting a plurality of insulation displacement terminals with terminal tips into the main housing of the insulation displacement terminal insert from the bottom side of the main housing so that the terminal tips extend from the bottom side of the main housing;

mounting the contact spring insert to the circuit board so that the spring tips project into the circuit board;

mounting the insulation displacement terminal insert to the circuit board so that the terminal tips project into the circuit board and make electrical contact with the spring tips through the electrical tracings on the circuit board;

sliding the circuit board with the insulation displacement terminal insert and the contact spring insert mounted thereon into the open channel of the jack housing by slidably aligning the longitudinal guides of the jack housing with the mating longitudinal guides of the insulation displacement terminal insert.

3. The method of claim 2, wherein the insulation displacement terminals are press fit into the main housing of the insulation displacement terminal insert.

4. The method of claim 2, wherein the contact springs are press fit into the contact spring insert.

5. The method of claim 2, wherein at least a portion of the contact spring insert is positioned between the insulation displacement terminal insert and the circuit board.

6. The method of claim 2, wherein the main housing of the insulation displacement terminal insert includes a central opening, wherein the contact spring insert is positioned within the central opening.

7. The method of claim 2, wherein the insulation displacement terminal insert includes a snap-fit connection structure for securing the insulation displacement terminal insert to the jack housing.

8. The method of claim 7, wherein the snap-fit connection structure includes two flexible lever members each having a locking tab, and the contact spring insert being positioned generally in a region between the flexible lever members.

9. The method of claim 8, wherein the jack housing includes a hole in each of the side walls for receiving one of the locking tabs.

* * * * *